US005439018A

United States Patent [19]

Tsai

[11] Patent Number: 5,439,018

[45] Date of Patent: Aug. 8, 1995

[54] TENT WITH A QUICK-ASSEMBLE AND COLLAPSIBLE FRAME

[76] Inventor: Tzung-Lin Tsai, No. 54-17, Lin 2, Huanya Li, Yenshui Chen, Tainan Hsien, Taiwan

[21] Appl. No.: 262,958

[22] Filed: Jun. 21, 1994

[51] Int. Cl.[6] ..... E04H 15/40

[52] U.S. Cl. ..... 135/143; 135/100; 135/116; 135/121; 135/137; 135/126

[58] Field of Search ..... 135/126, 87, 100, 121, 135/137, 139, 143 OR, 115, 119, 132, 137, 128, 116

[56] References Cited

U.S. PATENT DOCUMENTS

| | | | |
|---|---|---|---|
| 1,599,213 | 9/1926 | Coupal | 135/100 |
| 2,755,009 | 7/1956 | Parker | 135/100 X |
| 2,757,677 | 8/1956 | Denn | 135/100 X |
| 3,442,057 | 5/1969 | Perr | 135/100 X |
| 4,000,585 | 1/1977 | Denaro | 135/121 X |
| 4,265,261 | 5/1981 | Barker | 135/100 |
| 4,590,956 | 5/1986 | Griesenbeck | 135/119 X |
| 4,825,892 | 5/1989 | Norman | 135/126 |
| 5,038,812 | 8/1991 | Horman | 135/126 |
| 5,137,044 | 8/1992 | Brady | 135/126 |
| 5,301,705 | 4/1994 | Zheng | 135/126 |

FOREIGN PATENT DOCUMENTS

| | | | |
|---|---|---|---|
| 2635136 | 2/1990 | France | 135/126 |

*Primary Examiner*—Carl D. Friedman
*Assistant Examiner*—Wynn E. Wood
*Attorney, Agent, or Firm*—Hedman, Gibson & Costigan

[57] ABSTRACT

A tent includes a canvas and a frame. The canvas includes a rectangular floor piece and two pairs of opposite triangular side pieces thereby forming a substantially pyramid-like structure, the rectangular floor piece having a loop at each of four corners thereof. The frame includes two flexible triangular members respectively mounted to three sides of each of one pair of opposite triangular side pieces with top vertices of the triangular members meeting at an apex of the canvas. Each flexible triangular member is collapsible such that the vertices thereof coincide with one another. A fastening member passes through the loops after the triangular members are collapsed to retain the triangular members in the collapsed position.

2 Claims, 8 Drawing Sheets

TENT WITH A QUICK-ASSEMBLE AND COLLAPSIBLE FRAME

BACKGROUND OF THE INVENTION

1. Field of the Invention

The present invention relates to a tent and, more particularly, to a tent which can be quickly and easily assembled and collapsed.

2. Description of Related Art

Camping is one of the most popular outdoor activities, and tents are generally used to provide a temporary dwelling. However, it is troublesome and time-consuming to erect and dismantle tents of conventional structures. A yurt-like tent has been designed to replace conventional tents as no pegs are required to fix the yurt-like tent. However, like the conventional tents, the yurt-like tent still includes posts that require time-consuming connection and disconnection during erection and dismantling of the tent.

The present invention is intended to provide a tent with a structure which can be easily erected and dismantled.

SUMMARY OF THE INVENTION

In accordance with one aspect of the invention, a tent includes a canvas and a frame. The canvas includes a rectangular floor piece having a loop at each of four corners thereof and two pairs of opposite triangular side pieces thereby forming a substantially pyramid-like structure. The frame includes two flexible triangular members respectively mounted to three sides of each of one pair of opposite triangular side pieces with top vertices of the triangular members meeting at an apex of the canvas. The flexible triangular members are collapsible such that the vertices thereof coincide with one another. A fastening member passes through the loops after the triangular members are collapsed to retain the triangular members in the collapsed position.

In accordance with another aspect of the invention, a tent includes a canvas and a frame. The canvas includes a rectangular floor piece having a loop at each of four corners thereof, front and rear triangular pieces, and two side pieces which have a common upper edge. The frame includes two flexible triangular members and a flexible beam connected therebetween. The flexible triangular members are respectively mounted to three sides of each of the front and rear triangular pieces with the beam extending along the common upper edge of the side pieces. Each of the flexible triangular members and the flexible beam are collapsible such that vertices of the triangular beams coincide with one another. A fastening member passes through the loops after the triangular members are collapsed to retain the triangular members in the collapsed position.

Other objects, advantages, and novel features of the invention will become more apparent from the following detailed description when taken in conjunction with the accompanying drawings.

DESCRIPTION OF THE PREFERRED EMBODIMENTS

Figure 1:
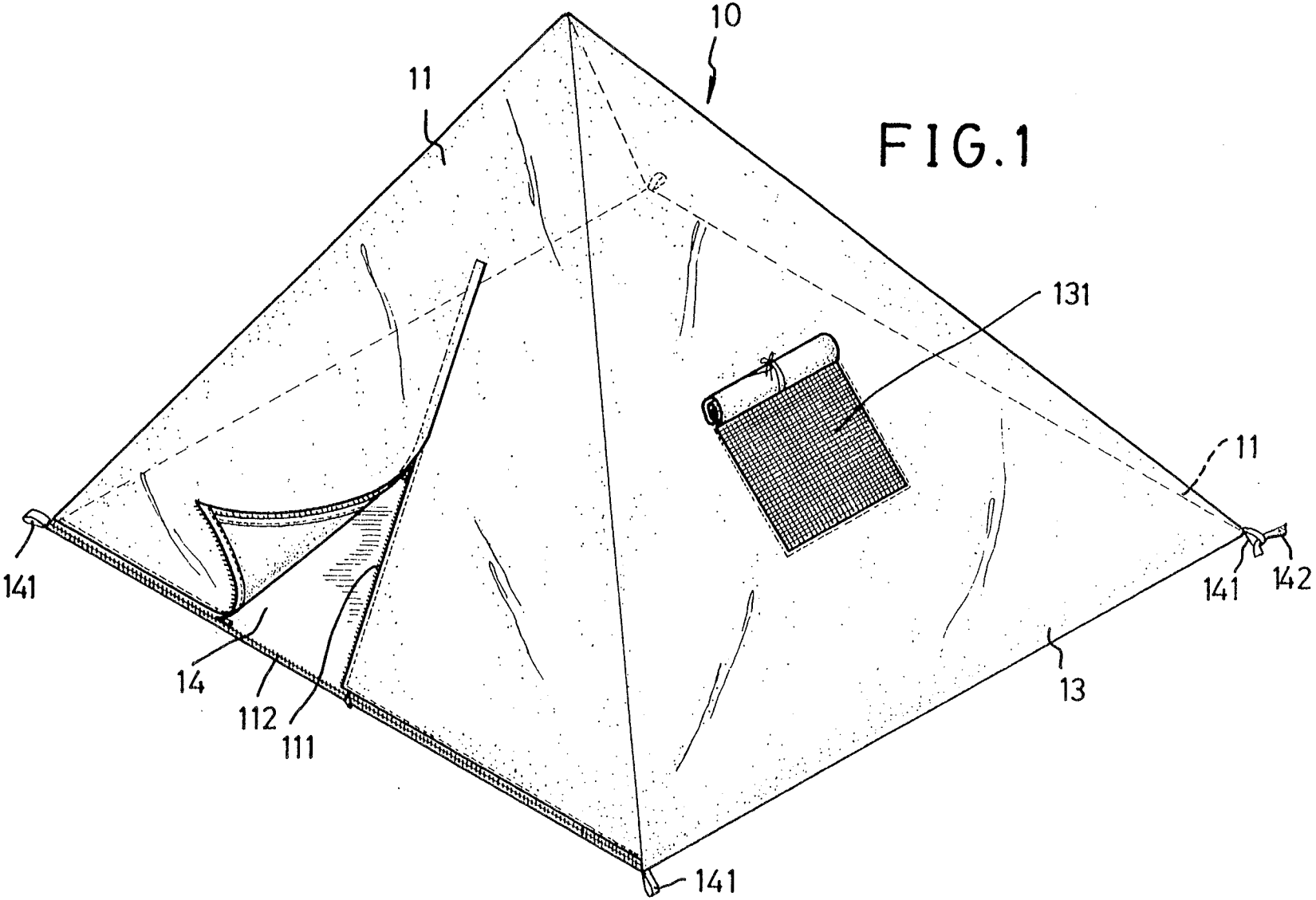
FIG. 1 is a perspective view of a tent in an assembled status in accordance with an embodiment of the present invention.
Figure 2:
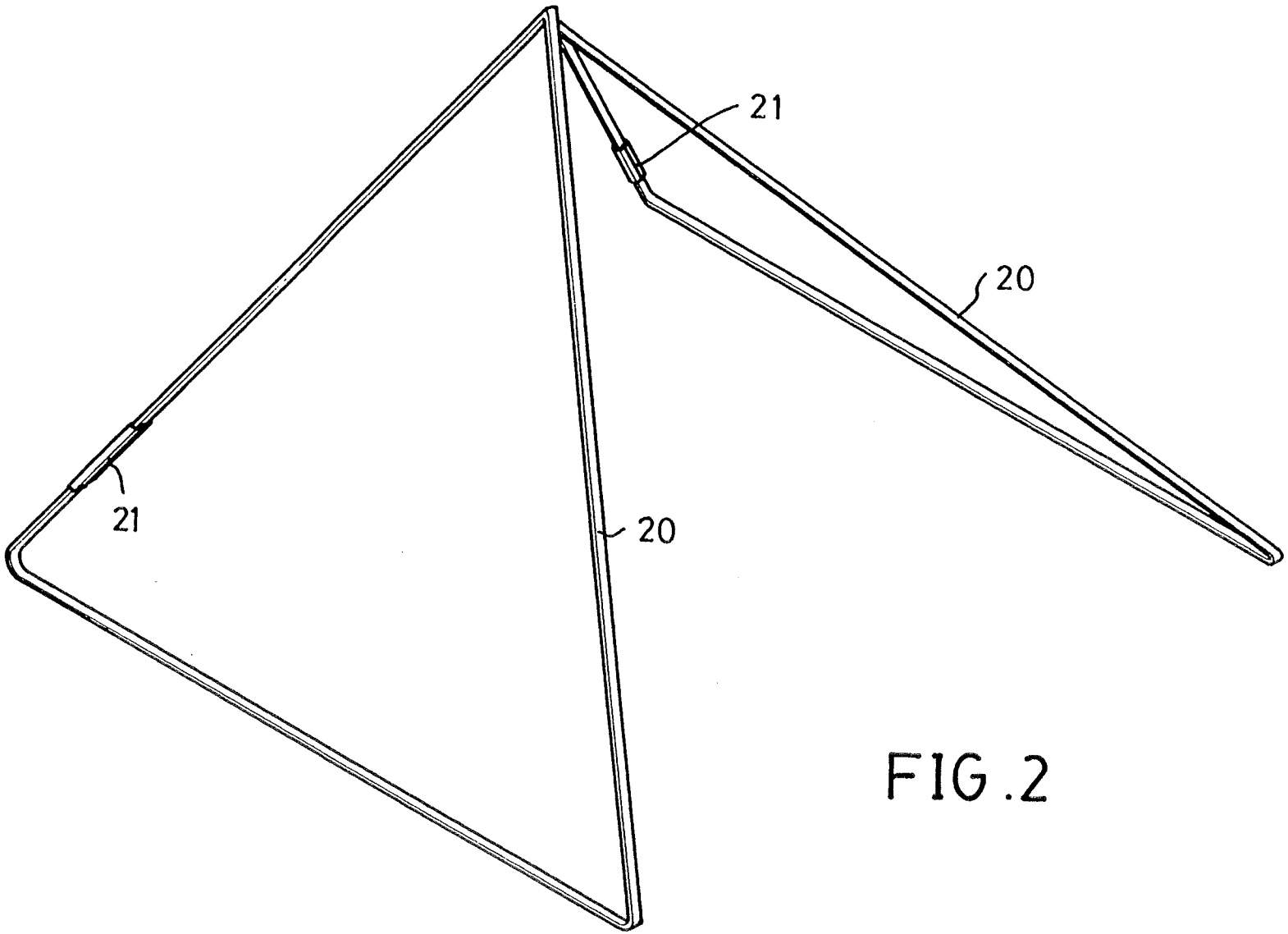
FIG. 2 is a perspective view illustrating an embodiment of a frame of the tent in FIG. 1.

Referring to the drawings, a tent shown in FIG. 1 is of a relatively small size and includes a canvas 10 and a frame comprising two triangular members 20 (see FIG. 2). The canvas 10 includes a substantially rectangular floor piece 14 and two pairs of opposite triangular side pieces 11 and 13, thereby forming a substantially pyramid structure. A loop 141 is provided to each of four corners of the floor piece 14. A zipper 111 is provided to one side piece 11 thereby providing an entrance 112 to the inner side of the tent, and a window 131 is provided to one of the side pieces 13.

Figure 3:
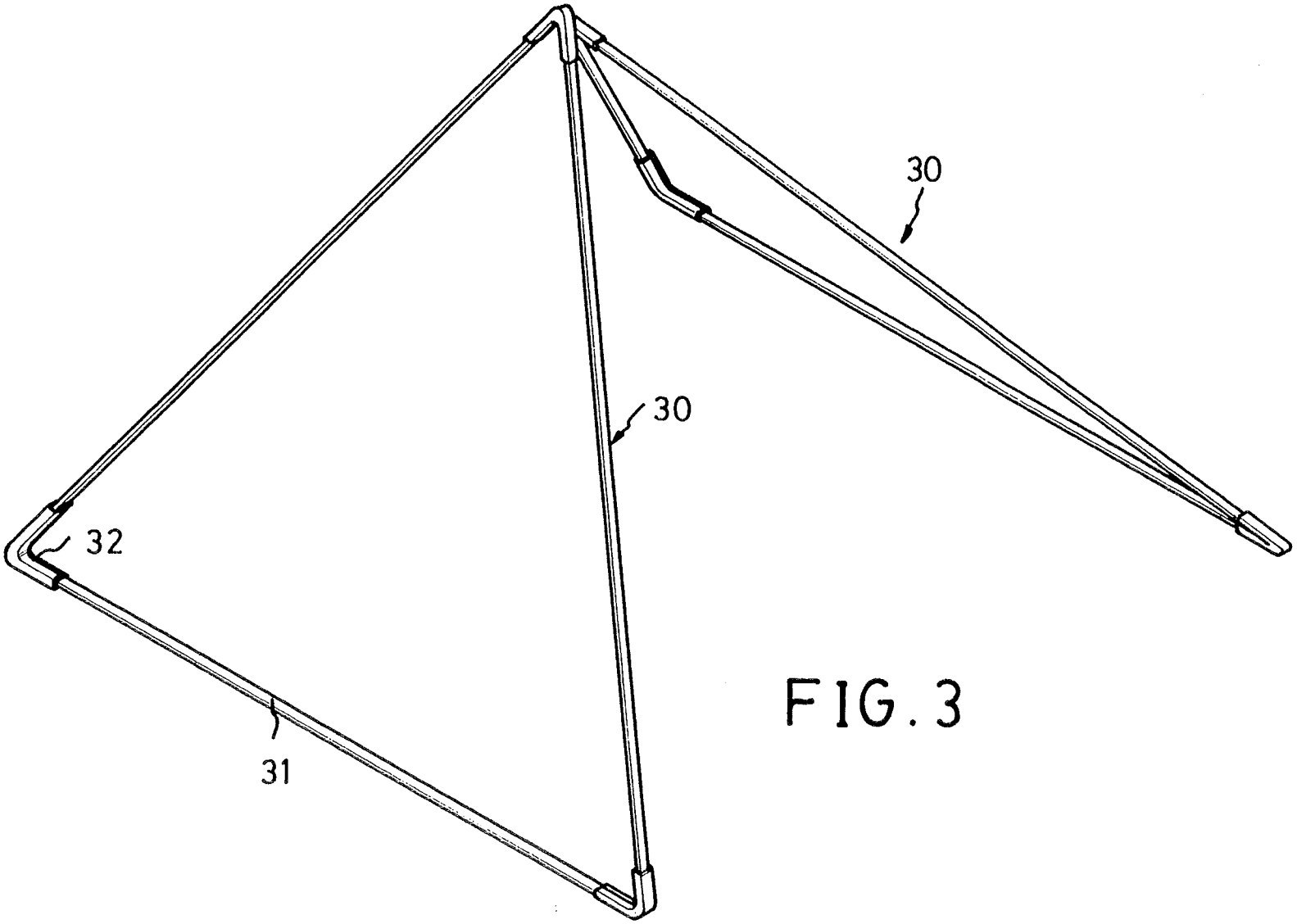
FIG. 3 is a perspective view illustrating another embodiment of a frame of the tent in FIG. 1.

The triangular members 20 may be mounted to three sides of either pair of the pieces 11 and 13 with the top vertices thereof meeting at the apex of the canvas 10. Preferably, the triangular member 20 is formed by bending a rod to form a triangular structure and a connecting piece 21 is provided to connect two ends of the rod. The triangular members 20 are made of flexible material and are inserted into the canvas before the pieces 11 and 13 are sewn together. FIG. 3 shows another embodiment of the frame in which the triangular member 30 is formed by means of using three connecting pieces 32 to interconnect three rods 31 to form a triangular structure.

Figure 4:
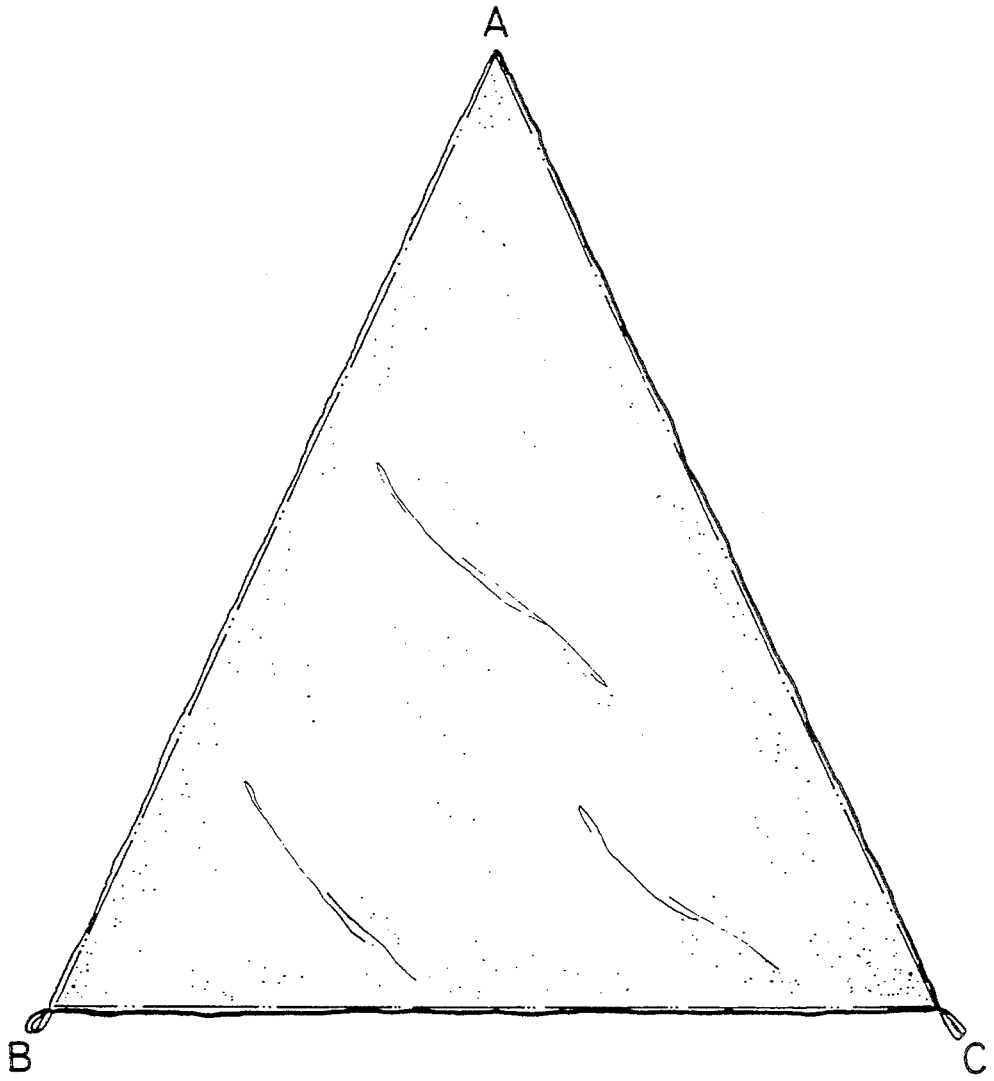
FIGS. 4 through 6 illustrate operation of collapse of the tent in accordance with the present invention.
Figure 5:
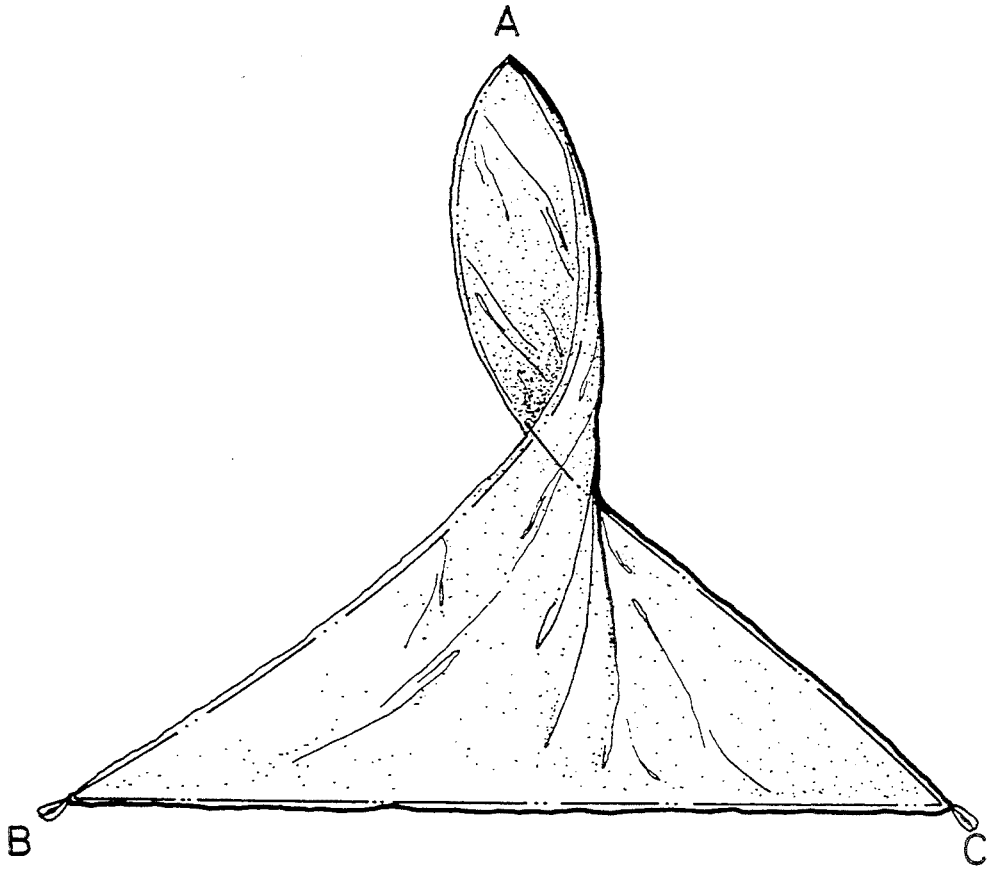
Figure 6:
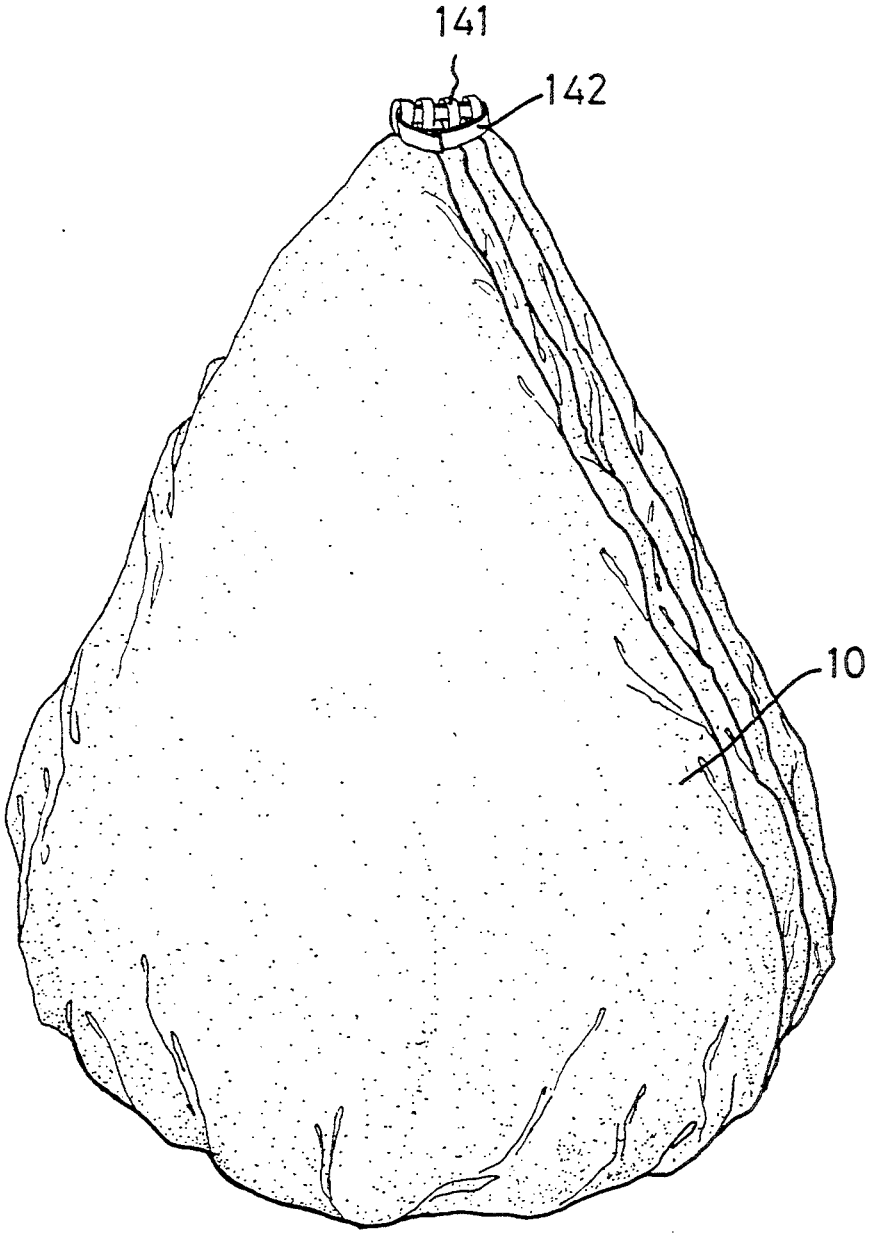

For dismantling the tent in FIG. 1 into a status shown in FIG. 6, the two triangular members 20 are firstly pivoted about their top vertices to coincide with each other and the resultant side view thereof is shown in FIG. 4. Then, the tent is twisted through 180° at vertex A thereof (see FIG. 5) and the vertex A is subsequently bent toward and thus coincides with the lower right vertex C. Thereafter, the lower left vertex B is also bent to coincide with vertices A and C, such status is shown in FIG. 6, in which the user may pass a fastener 142 (such as hook and loop fastener or other suitable fasteners) through the loops 141 to complete the collapse of the tent. Thus, the tent can be easily dismantled and is convenient for carriage.

When going camping, the user may simply untie the fastener 142, and then the tent can be quickly erected due to the unfolding of the flexible triangular members 20.

Figure 7:
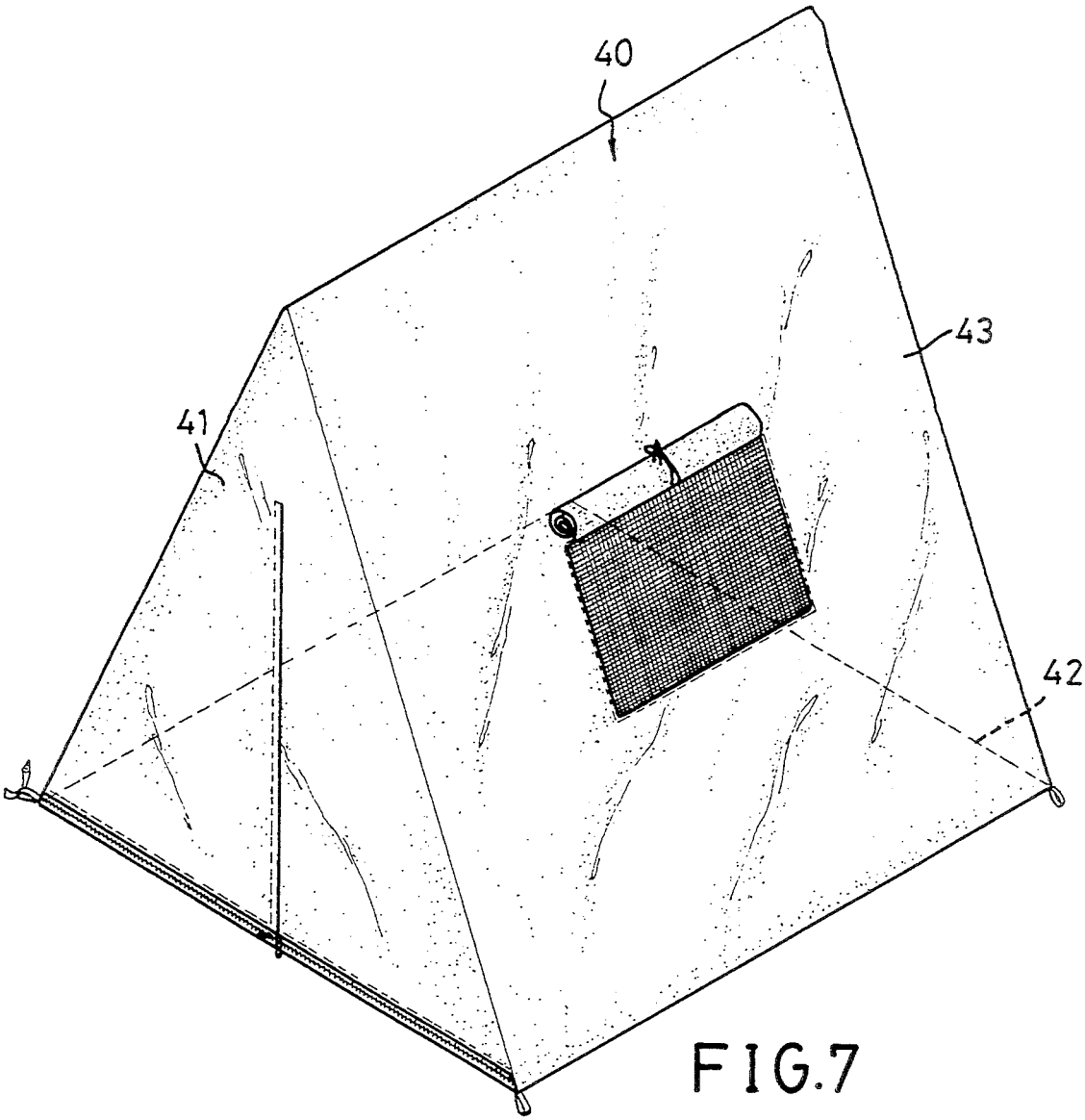
FIG. 7 is a perspective view of another embodiment of a tent in accordance with the present invention.
Figure 8:
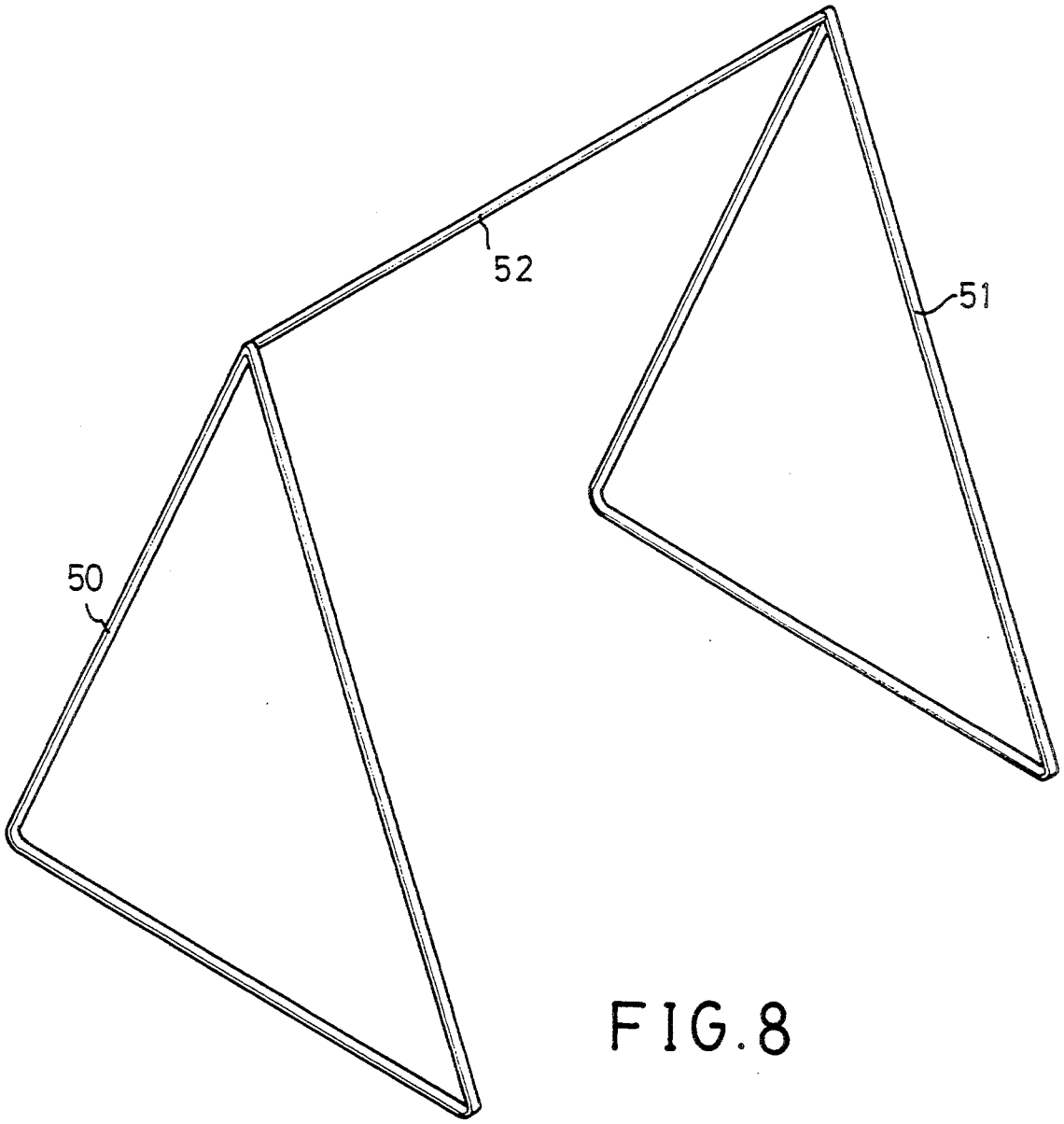
FIG. 8 is a perspective view illustrating a frame of the tent in FIG. 7.

FIG. 7 shows a tent of a relatively large size. The tent includes a canvas having a rectangular floor piece (not labeled), front and rear triangular pieces 41 and 42, and two rectangular side pieces 43. As shown in FIG. 8, the tent further includes a frame comprising a pair of triangular members 50 and 51 interconnected by a beam 52. The triangular members 50 and 51 are respectively mounted to three sides of each of the triangular pieces 41 and 42 with the beam 52 extending along the common upper edge of the rectangular side pieces 43. It is appreciated that the triangular members 50 and 51 as well as the beam 52 are made of flexible material to allow dismantling of the tent.

For dismantling the tent shown in FIGS. 7 and 8, the triangular members 50 and 51 are moved to coincide with each other by bending the flexible beam 52 therebetween. The resultant status is similar to that shown in FIG. 4, and the following procedure for dismantling the tent of the second embodiment is identical to that for dismantling the tent of the first embodiment as illustrated in the above.

According to the above description, it is appreciated that the invention provides a tent with a structure which can be easily assembled and collapsed to minimize the volume thereof.

Although the invention has been explained in relation to its preferred embodiment, it is to be understood that many other possible modifications and variations can be made without departing from the spirit and scope of the invention as hereinafter claimed.

I claim:

1. A tent comprising:

a canvas comprising a rectangular floor piece and two pairs of opposite triangular side pieces thereby forming a substantially pyramid-like structure, the rectangular floor piece having a loop at each of four corners thereof;

a frame comprising two flexible triangular members respectively mounted to three sides of each of one of said pairs of opposite triangular side pieces with top vertices of the triangular members meeting at an apex of the canvas, each of the flexible triangular members being collapsible such that the vertices thereof coincide with one another; and a fastening means passing through the loops after the triangular members are collapsed to retain the triangular members in the collapsed position.

2. A tent comprising:

a canvas comprising a rectangular floor piece, front and rear triangular pieces, and two side pieces which have a common upper edge, the rectangular floor piece having a loop at each of four corners thereof; and a frame comprising two flexible triangular members and a flexible beam connected therebetween, the flexible triangular members being respectively mounted to three sides of each of the front and rear triangular pieces with the beam extending along the common upper edge of the side pieces, each of the flexible triangular members and the flexible beam being collapsible such that the vertices of the triangular members coincide with each other; and a fastening means passing through the loops after the triangular members are collapsed to retain the triangular members in the collapsed position.

* * * * *